US008087359B2

(12) United States Patent
Sauvestre

(10) Patent No.: US 8,087,359 B2
(45) **Date of Patent: *Jan. 3, 2012**

(54) HUNTING BULLET COMPRISING AN EXPANSION RING

(76) Inventor: Jean-Claude Sauvestre, Saint-Doulchard (FR)

( * ) Notice: Subject to any disclaimer, the term of this patent is extended or adjusted under 35 U.S.C. 154(b) by 0 days.

This patent is subject to a terminal disclaimer.

(21) Appl. No.: 12/534,639

(22) Filed: Aug. 3, 2009

(65) Prior Publication Data

US 2009/0288572 A1 Nov. 26, 2009

Related U.S. Application Data

(63) Continuation of application No. 10/592,136, filed on Sep. 8, 2006, now abandoned.

(30) Foreign Application Priority Data

Mar. 8, 2004 (FR) ..... 04 02403

(51) Int. Cl.
*F42B 12/02* (2006.01)
*F42B 12/34* (2006.01)

(52) U.S. Cl. ..... 102/439; 102/507; 102/508

(58) Field of Classification Search ..... 102/507–510, 102/514, 520–523, 439, 398
See application file for complete search history.

(56) References Cited

U.S. PATENT DOCUMENTS

| | | | | |
|---|---|---|---|---|
| 3,262,391 | A * | 7/1966 | Shober | 102/521 |
| 5,160,805 | A * | 11/1992 | Winter | 102/518 |
| 5,289,777 | A * | 3/1994 | Sippel et al. | 102/521 |
| 5,789,699 | A * | 8/1998 | Stewart et al. | 102/521 |
| 5,804,759 | A * | 9/1998 | Sauvestre | 102/439 |
| 6,845,717 | B1 * | 1/2005 | Sauvestre | 102/518 |
| 2004/0244631 | A1 * | 12/2004 | Eches et al. | 102/521 |

* cited by examiner

*Primary Examiner* — Bret Hayes
(74) *Attorney, Agent, or Firm* — Merchant & Gould

(57) ABSTRACT

Ammunition consists of a full-caliber or sub-caliber bullet, of the type comprising a substantially rigid bullet body and a deformable part, the deformable part consisting of an approximately cylindrical expansion ring, the rear part of which is fitted onto the front part of the bullet body.

13 Claims, 3 Drawing Sheets

30
28
27
16
31

8
6
9

59
33
34

HUNTING BULLET COMPRISING AN EXPANSION RING

The present application is a continuation of U.S. application Ser. No. 10/592,136 filed on Sep. 8, 2006 now abandoned, which is incorporated by referenced herein in its entirety.

The present invention relates to ammunition for small, medium and large caliber guns, and more particularly to improved ammunition, especially for hunting guns, with improved effectiveness, by expanding on hitting the target.

BACKGROUND OF THE INVENTION

Bullets for hunting firearms are conventionally divided between full-caliber bullets and subcaliber bullets.

Conventional full-caliber bullets are generally made of lead or a lead alloy. They do not fragment and expand only very slightly upon impact with the target. Certain bullets include fracture initiators which cause the body of the bullet to fragment upon impact. These bullets are fired at relatively low velocity, less than 500 m/s, and are ineffective against moderately or highly resistant targets, such as large game animals, for example wild boar.

Subcaliber bullets include a subprojectile, possibly fin-stabilized, combined with a full-caliber sabot, which separates upon leaving the barrel of the gun.

All these conventional bullets have drawbacks generally associated with their inaccuracy, with their ballistic dispersion and their lack of effectiveness against targets having hard parts.

So-called expanding bullets, which deform upon impact by mushrooming, including against moderately resistant targets, have been described in the art. For example, U.S. Pat. No. 4,685,397 describes a bullet with an ogival body, the head of which includes a blind hole closed off by an insert capable of penetrating the hole upon impact and of pushing the wall of the ogive outward. Patent EP-A-918 208 describes another embodiment of such a bullet having a cylindrical body and an ogival head, with a blind hole along its axis, closed off by an insert, and supplemented with a peripheral annular groove. Thus, upon impact, the insert penetrates the blind hole and causes the ogival head to deform by expansion, which is facilitated by the annular groove. Application PCT WO 03/093758 describes a partially fragmenting expanding bullet that includes an orifice located in the ogival head, completely closed by a plug fitted onto a rod, the movement of which causes the bullet body to deform.

However, expanding ammunition of this type have the drawback of random control of the deformation according to the shooting conditions, being accompanied by a risk of the ogival head of the bullet fragmenting.

Further improved ammunition for hunting guns have been developed on the principle of the "dart" bullet. Ammunition of this type are described for example in FR-A-2 555 728. Upon impact of ammunition of this type on the target, the dart deforms, and it is desirable that this deformation be controlled and not cause excessive dislocation of the dart into several small fragments which could prove to be dangerous. Patent FR-A-2 795 170 describes ammunition that meet this objective, which essentially consist of a full-caliber or subcaliber bullet comprising a profiled front part, a central part and a rear part, which is possibly finned, and including, lying along its axis, a supported internal dart which is at least as rigid as the bullet body. Bullets of this type are very accurate and have the advantage of retaining their mass upon impact against the target. According to this art, the diameter of the ogival nose represents between 40% and 50% of the maximum diameter of the bullet, thereby giving it a high aerodynamic drag. These bullets are therefore mainly intended for what is called "brush" shooting, over short and medium distances, of less than 150 m in the case of rifles and around 50 to 60 m in the case of shotguns.

Another type of ammunition in which the bullet body includes an orifice completely closed by a closure cap is described in U.S. Pat. No. 6,349,651, but the closure cap bears on the front face of the bullet body. An embodiment of a hunting bullet with delayed expansion is described in patent EP 1 394 498, in which the bullet body is completely penetrated by an element which, upon impact, causes the bullet body to deform. Patent DE 19 903 395 describes a bullet having a metal core with an enlarged base, supporting an outer jacket with an open ogival head protruding from the central core.

However, the ballistic performance of the ammunition of this type is inferior when they are fired from hunting guns in which the initial velocity is relatively slow, that is to say less than about 600 m/s. In addition, their relative high aerodynamic drag has the effect of limiting the velocity of impact on the target. It is known that the velocity of impact on the target, the mass of the bullet and its configuration are three essential parameters that must be controlled in order to achieve a good stopping power by a cavitation effect in the target.

Thus, at the present time there is a need to be able to have ammunition, especially for hunting guns, which exhibit controlled expansion upon impact, in particular on weakly resistant targets, and which release their energy effectively.

SUMMARY OF THE INVENTION

One object of the present invention is specifically to optimize the terminal ballistics of a lead-free metal bullet of the type above, so as to provide accelerated expansion, while preventing the loss of mass by fragmentation and providing excellent effectiveness against possible hard parts present in the target.

Another object of the invention is to provide a round for hunting guns, as mentioned above, which provides accelerated expansion upon impact against the target, in particular against a weakly or moderately resistant target.

Yet another object of the invention is to provide a round for hunting guns with improved terminal effectiveness against the weakly or moderately resistant target, which consists of a cartridge, made up of a primed cartridge case, a propulsion powder charge and a complete bullet, possibly combined with a full-caliber sabot.

The final object of the invention is to provide a lead-free round for hunting guns that possesses optimized terminal ballistics, providing almost complete release of the energy in the soft parts of the target, while avoiding any fragmentation of the bullet upon impact.

DETAILED DESCRIPTION OF THE PREFERRED EMBODIMENTS

Figure 1:
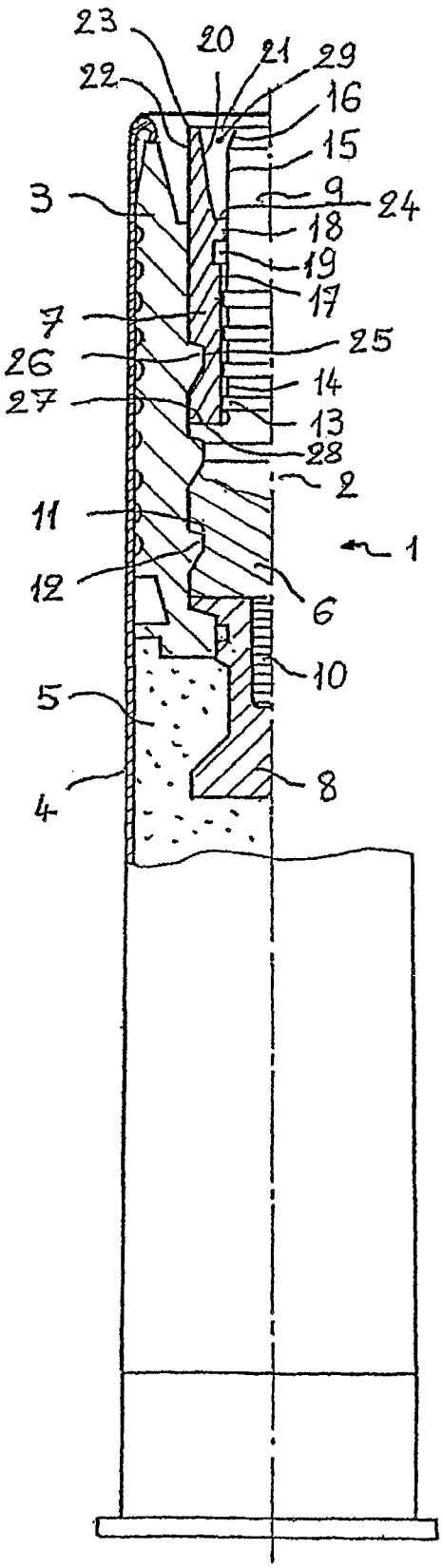
FIG. 1 shows a schematic half-view in partial cross section of a fin-stabilized subcaliber bullet, according to the invention, for hunting shotguns.

The present invention applies to small, medium or large caliber ammunition, of the full-caliber or subcaliber type, for hunting guns with a smooth or rifled barrel.

The round for small, medium and large caliber guns according to the present invention consists of a full-caliber or subcaliber bullet, of the type comprising a substantially rigid bullet body and a deformable part, which round is distinguished in that the deformable part consists of an approximately cylindrical expansion ring, the rear part of which is fitted onto the front part of the bullet body.

According to a preferred embodiment of the invention, the cylindrical expansion ring is fastened via its rear end to the bullet body, and the fastening may advantageously be detachable from the bullet body.

It is preferable for the expansion ring to include means that cooperate with the bullet body in order to prevent its recoil upon impact against the target, in such a way that the energy released upon impact is partly absorbed by the deformation of the ring. These means may consist of a stop integral with the rear part of the ring, which bears against a shoulder on the bullet body. It may be advantageous to provide for the bullet body to include a shoulder against which the rear face of the cylindrical ring butts.

According to a complementary feature of the invention, the expansion ring includes, on its front face, an emergent frustoconical bore, which cooperates with the front face of the head of the bullet body in order to form an open cavity. The volume and the angle of opening of this cavity are determined according to the desired results, by applying conventional computational methods for achieving the maximum stopping power on the target, by a disintegration, penetration and hydrodynamic cavitation effect.

Advantageously, the emergent frustoconical bore on the front face of the expansion ring is designed to form, with the external cylindrical part of the ring, a narrow expansion flat or lip, which facilitates the expansion movement of the ring upon impact against the target.

According to one advantageous feature of the invention, the base of the emergent frustoconical bore comprises an annular bearing surface that bears against the cylindrical surface of the head of the bullet body and is capable of sliding over said cylindrical surface. This annular bearing surface is separated from the rear part of the cylindrical ring by an annular groove.

The annular bearing surface allows the ring to deform by uniform expansion, while preventing any misalignment with respect to the axis of the bullet. Thus, it ensures that the ring is held in place at all shooting angles, including shooting tangentially, which generates large radial forces. Finally, said annular surface contributes to good catching of the bullet in the case of impact on the ground, by keeping the ring along the axis of the bullet body, and consequently reduces the propensity to lateral ricochets of the bullet, and thus increases safety when shooting.

The external surface of the expansion ring is generally cylindrical, but it may be slightly curved and slightly conical, especially in the case of a full-caliber bullet. According to a preferred embodiment, the outer surface of the cylindrical ring has a curvilinear ogival shape.

In general, the front face of the expansion ring lies substantially in the plane of the face of the head of the bullet body. However, depending on the desired effect, it may be protruding, which makes it possible to reduce the aerodynamic drag, or on the contrary slightly set back.

The bullet body includes a front part that supports the expansion ring, of cylindrical shape, terminating in a conical or frustoconical tip. This part constitutes a dart intended to fragment the possibly hard parts present in the target.

The terms "front part" and "rear part" used here denote the front and rear, respectively, of the bullet in the direction of shooting. Thus, the dart corresponds substantially to the front part of the bullet body.

The bullet body may for example be made of copper, preferably copper that is thermally or mechanically treated in order to increase its hardness and its rigidity, or made from brass containing 5 to 40% zinc and 95 to 60% copper, preferably brass containing 20 to 30% zinc, or made of a metal alloy having the desired mechanical properties, for example an aluminum alloy, or made of a composite based on tungsten or bismuth. Compared with the conventional techniques, the technique of the invention has the advantage of allowing lead to be completely or partly replaced with another metal or an alloy deemed to be nonpolluting. In the case of a fin-stabilized bullet, the finning may be made of a metal or of a polymer formed by plastic processing directly on the metal body of the subprojectile.

As indicated above, the bullet body used in the ammunition of the invention advantageously includes a front part with an axisymmetric dart. The bullet body and the dart are preferably manufactured in the same material, for example copper or brass, the dart being machined directly on the bullet body. In general, the dart has the form of a shaft or a cone of revolution, coaxial with the projectile. It is advantageous to provide ribs or projections on the external surface of the dart so as to improve the fastening of the expansion ring. For example, the grooves may be annular or helical, cooperating with the means provided on the internal face of the ring.

In alternative embodiments according to the invention, the expansion ring is attached to the bullet body by screwing, friction welding, shrink-fitting or force-fitting, for example by means of a diamond-shaped knurled contact surface.

The expansion ring is preferably made of a metal or a metal alloy, for example brass, of the same or lower rigidity, preferably lower rigidity, than the bullet body. This difference in rigidity between the bullet body and the expansion ring may be obtained for example by choosing brasses that have an appropriate zinc content. Fracture initiators may be provided on the expansion ring. These fraction initiators, by cooperating with the more rigid dart, favor deformation of the bullet head upon impact, by "mushrooming" around the central dart, which retains its general shape and serves as a structure for providing the assembly with cohesion. They may also be combined with circular or longitudinal grooves cut along the perimeter of the bullet, preferably in the region that deforms by expanding, the deformation of which has to be controlled.

As indicated above, the bullet may be of the gyro-stabilized or fin-stabilized type. A gyro-stabilized bullet is used in a rifled barrel gun, in such a way that the rifling of the barrel, by cooperating with a tenon integral with the bullet, causes the latter to rotate about its axis. Fin-stabilized bullets may be used in smooth barrel guns.

In the case of a subcaliber bullet, the launch sabot may be in accordance with those described in patents FR-A-2 606 500 and FR-A-2 708 730.

The ammunition according to the present invention may be used against relatively hard and highly resistant targets, and also against soft targets of low resistance against which they provide excellent terminal effectiveness. This excellent effectiveness results in particular from the controlled expansion effect upon impact, after perforation of the hard and possibly resistant parts present in the target. It is achieved while maintaining the aerodynamic parameters of the close-range bullets with a supported internal dart using the technique described in the aforementioned patent FR-A-2 795 170, even at large distances, of around 300 m and more in the case of gyro-stabilized bullets. The point of impact is therefore identical to that of the aforementioned close-range bullets with a supported internal dart, thanks to the aerodynamic parameters and to the flightwise construction of the bullet.

In addition, shooting safety is provided at all angles of shooting against the target, including tangential angles, thanks to the open cavity formed on the front part of the bullet, combined with the relatively small diameter of the tip of the ogival head, thus limiting its propensity to ricocheting.

The ammunition of the invention are therefore most particularly suitable for hunting small game or medium-sized game, but they may also be suitable for large game with a relatively thick and resistant skin.

Figure 3:
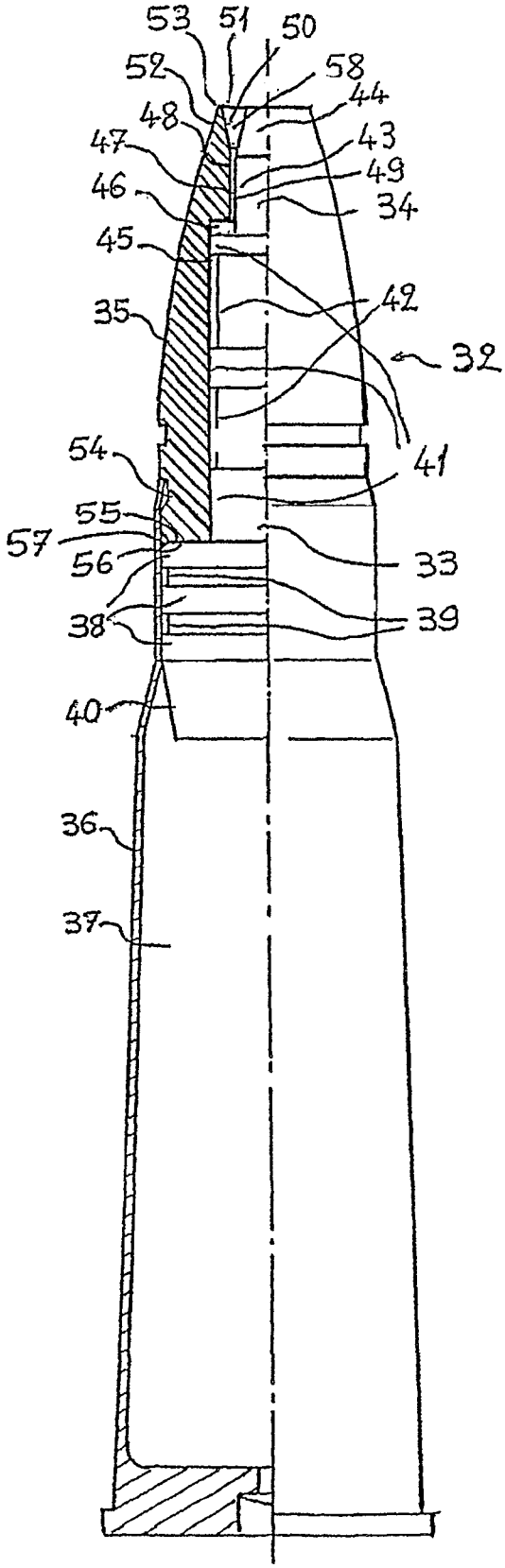
FIG. 3 shows a schematic view, in half-cross section, of an alternative embodiment of the invention, representing a full-caliber bullet, more particularly suitable for large game hunting rifles.
Figure 2:
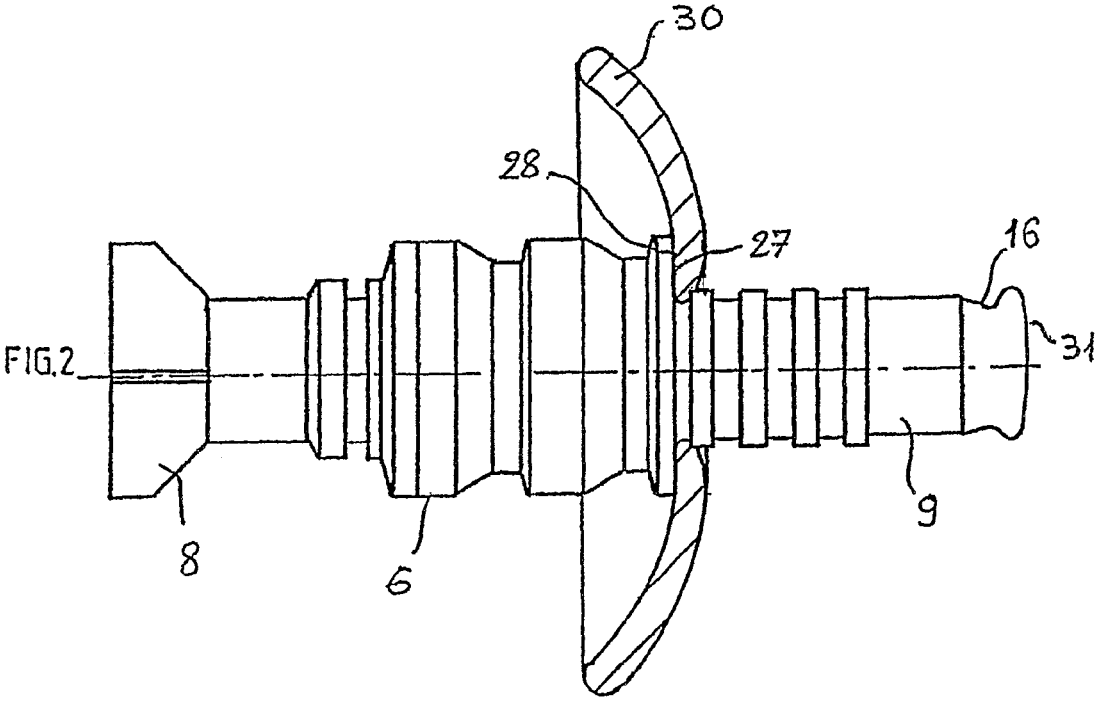
FIG. 2 shows a view in partial cross section of the bullet of FIG. 1, expanded after penetration in the target.
Figure 4:
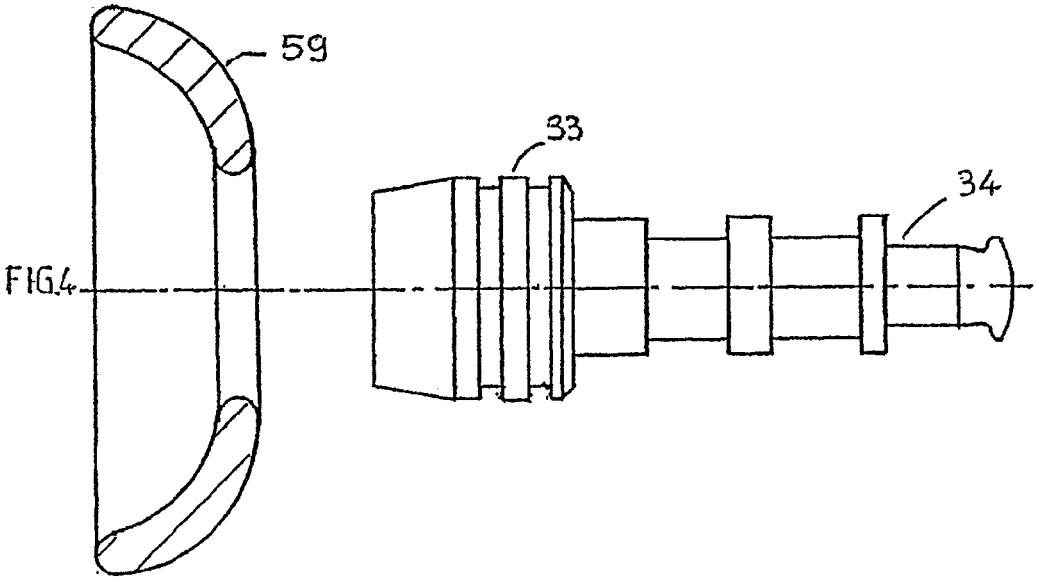
FIG. 4 shows a schematic cross-sectional view of the ring of the bullet shown in FIG. 3, after expansion upon impact against a highly resistant target and separation from the bullet body.
Figure 5:
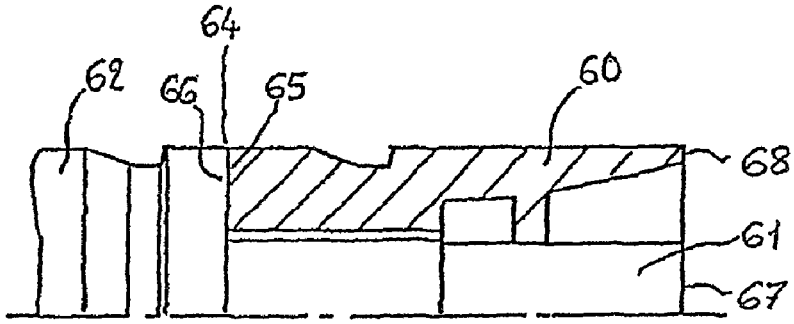
FIG. 5 shows a partial half-view, in partial cross section, of an alternative embodiment of the front part of the bullet of FIG. 1, which includes a threaded link between the expansion ring and the bullet body.
Figure 6:
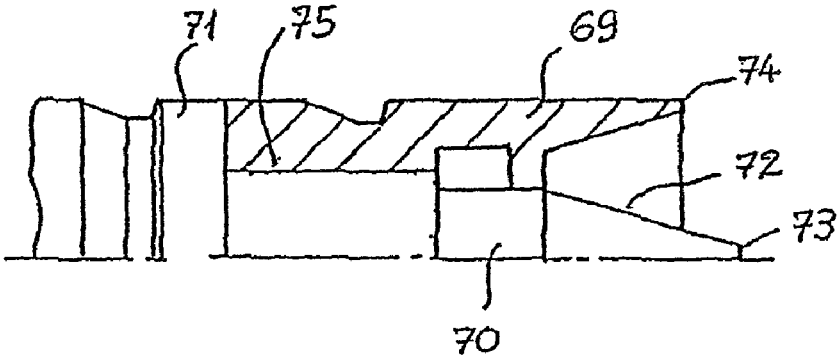
FIG. 6 shows a partial half-view, in partial cross section, of another alternative embodiment of the front part of the bullet of FIG. 1, which includes a shrunk-fitted link between the expansion ring and the bullet body.
Figure 7:
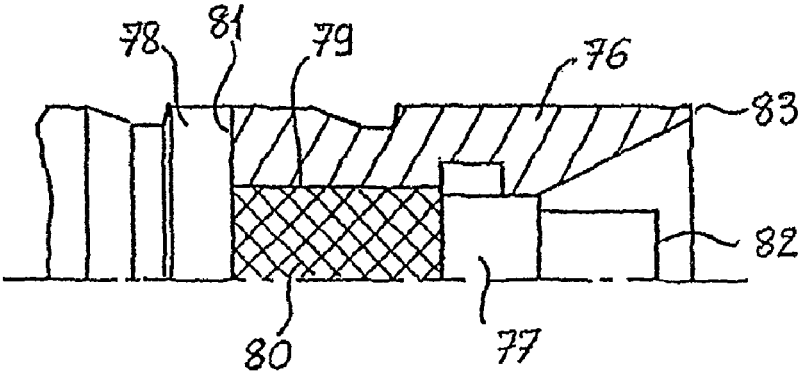
FIG. 7 shows a partial half-view, in partial cross section, of another alternative embodiment of the front part of the bullet of FIG. 1, which includes a diamond-shaped knurled link between the expansion ring and the bullet body.

The features and advantages of the invention will become apparent in greater detail in the description below that relates to nonlimiting examples, with reference to the appended drawings which show:

FIG. 1, a schematic half-view in partial cross section of a fin-stabilized subcaliber bullet, according to the invention, for hunting shotguns;

FIG. 2, a view in partial cross section of the bullet of FIG. 1, expanded after penetration in the target;

FIG. 3, a schematic view, in half-cross section, of an alternative embodiment of the invention, representing a full-caliber bullet, more particularly suitable for large game hunting rifles;

FIG. 4, a schematic cross-sectional view of the ring of the bullet shown in FIG. 3, after expansion upon impact against a highly resistant target and separation from the bullet body;

FIG. 5, a partial half-view, in partial cross section, of an alternative embodiment of the front part of the bullet of FIG. 1, which includes a threaded link between the expansion ring and the bullet body;

FIG. 6, a partial half-view, in partial cross section, of another alternative embodiment of the front part of the bullet of FIG. 1, which includes a shrunk-fitted link between the expansion ring and the bullet body; and FIG. 7, a partial half-view, in partial cross section, of another alternative embodiment of the front part of the bullet of FIG. 1, which includes a diamond-shaped knurled link between the expansion ring and the bullet body.

As shown in FIG. 1, the bullet (1) comprises a subcaliber bullet (2) and a launch sabot (3), the whole assembly being placed conventionally in a primed cartridge case (4) containing a propulsion charge (5). As usual, the launch sabot (3) consists of two identical semicylindrical elements surrounding the body of the bullet (1).

The subcaliber bullet (2) comprises a bullet body (6) that houses an expansion ring (7) in its front part, and a fin (8) in its rear part. The front part of the bullet body (6) includes an axisymmetric dart (9). This dart (9) is integral with the bullet body (6) and may be manufactured, for example, by directly machining it into the bullet body. The rear part of the bullet body (6) includes a splined or threaded part (10) allowing the fin (8) to be fastened. The central part of the bullet body (6) has, on its external surface, grooves (11) that cooperate with teeth (12) formed in the internal face of the launch sabot (3).

The dart (9) has a diameter corresponding approximately to one half of the outside diameter of the bullet body (6). The rear part of the dart (9) includes several narrow cylindrical bearing surfaces (13) separated by narrow grooves (14). The outside diameter of the cylindrical bearing surfaces (13) is slightly greater, by a few tenths of a millimeter, than the cylindrical part (15) of the dart lying forward of the bearing surfaces (13). The front part of the dart (9) has a frustoconical shape (16).

The bullet body (6), including the dart (9), is made of a brass that contains 30% zinc, and the expansion ring is of a make of a brass, the zinc content of which is 20%, having a lower rigidity than the bullet body.

A bore (17) is formed inside the rear part of the expansion ring (7). The diameter of this bore (17) is slightly less, by a few hundredths of a millimeter, than the cylindrical bearing surfaces (13) of the dart (9). The ring also includes an annular bearing surface (18) capable of sliding on the cylindrical part (15) of the dart (9). This bearing surface (18) is separated from the bore (17) by a groove (19).

A frustoconical bore (20) emerging on the front face (21) of the expansion ring (7) forms, with the external cylindrical part (22) of the ring (7), a narrow expansion flat or lip (23). The small base (24) of the frustoconical bore (20) has an outside diameter at least equal to that of the bottom of the groove (19).

A groove (25) formed in the external face of the expansion ring (7) cooperates with a tooth (26) formed in the internal face of the launch sabot (3).

The expansion ring (7) is fitted via its rear part onto the dart (9) of the bullet body (6), by force-fitting it, by cold shrinking of the bore (17) of the ring (7) onto the cylindrical bearing surfaces (13) of the dart (9). Since the outside diameter of the cylindrical bearing surfaces (13) is slightly greater than that of the bore (17), the ring (7) is force-fitted until its rear face (27) comes into contact against the shoulder (28) on the bullet body (6).

The cylindrical bearing surface (18) of the cylindrical expansion ring (7) slides freely over the cylindrical part (15) of the dart (9), ensuring, on the one hand, perfect alignment of the ring (7) on the bullet body (6) and, on the other hand, excellent coaxiality of the ring (7) on the bullet body (6).

An open cavity (29) is bounded by the face (21), the conical bore (20) and the small base (24) of the expansion ring (7), on the one hand, and by the cylindrical part (15) and the conical part (16) of the dart (9), on the other. The volume and the angle of opening of this cavity (29) are determined using the conventional computational methods according to the desired results, in order to achieve the maximum stopping power on the target.

FIG. 2 shows a partial view of the bullet of FIG. 1, fired by means of a hunting shotgun into a reference target (a Plastiline® block), the velocity of impact of the bullet being 420 m/s and its mass 21 g. This figure demonstrates the operation of the bullet, after penetration in the target and expansion of the ring.

Upon impact against the target, the expansion ring (7) exerts a punching effect on the wall of the target, making it possible to establish a hydrodynamic pressure in the open cavity (29) of the bullet (2), causing progressive outward deformation of the expansion lip (23), thus initiating the expansion process of the ring (7) until the mechanical forces resisting the deformation of the ring are greater than the hydrodynamic pressures exerted.

The expanded ring (30) remains attached to the bullet body (6) by means of the bearing of its rear face (27) against the shoulder (28) of the bullet body (6). In this example, the projected expanded surface of the ring (7) represents about 4.5 times the cross section of the bullet in flight, and the expanded ring is perfectly circular, with the appearance of no cracking or radial opening of the corolla. The dart (9) integral with the bullet body (6) makes it possible to destroy the possibly hard parts present in the target. The impact against the target causes slight deformation (31) of the conical part (16) of the head of the dart (9). Of course, this deformation may vary depending on the shooting conditions and the properties of the target.

The annular bearing surface (18) ensures that the ring (7) deforms by uniform expansion, preventing any misalignment relative to the axis of the bullet (2). It also ensures that the ring is held in place at all firing angles, including when fired tangentially, which generates large radial forces.

The hunting bullet shown in FIGS. 1 and 2 is designed to be fired more particularly from hunting guns with a smooth or slightly rifled barrel. The bullet is stabilized over its projectory by the fins (8) which ensure that the geometrical axis of the bullet is optimally coincident with the tangent to the trajectory described by its center of gravity. A very slight rotation along the trajectory, of about 20 revolutions per second, may be imposed on this type of bullet, causing negligible radial mechanical stresses on the components of the bullet.

FIG. 3 shows an alternative embodiment of the invention applied to a full-caliber bullet, more particularly suitable for large-game hunting rifles.

The bullet of FIG. 3 comprises a caliber bullet (32) comprising a bullet body (33), surmounted by a dart (34) integral with the bullet body (33), and by an expansion ring (35), the whole assembly being placed in the usual manner in a primed metal cartridge case (36) containing an explosive powder charge (37).

The bullet body (33) has, in its rear part, three approximately identical full-caliber bearing surfaces (38) corresponding to the bottom diameter of the gun barrel rifling, which are separated from each other by two grooves (39) for decompression of the gases resulting from the combustion of the powder, and also a trailing cone (40) conventionally designed according to the aerodynamic study of the bullet.

The front part of the bullet body (33) includes a subcaliber dart (34) relative to the bullet body (33) and integral therewith. Three lands (41), of the same outside diameter and of height that decreases from the base toward the head of the dart (34), are separated by two circular recesses (42) of substantially the same height as, and of slightly smaller diameter, by a few tenths of a millimeter, than those of the lands (41). A cylindrical shoulder (43) of smaller diameter than the circular recesses (42) is placed between the lands (41) and the conical head (44) of the dart (34).

The expansion ring (35) has an axial bore (45) capable of sliding over the three lands (41). A longitudinal clearance (46) of about 1.5 mm is provided beyond the third land toward the head of the dart (34). A functional clearance (47) of about 1 mm is provided between the bore (48) of the front of the ring (35) and the diameter (49) of the cylindrical shoulder (43) of the head of the dart (34). The diameter of the bore (48) is slightly smaller than that of the bore (45). A conical bore (50) emerging on the front face (51) of the ring (35) forms, with the curvilinear ogive (52), an expansion lip (53).

A crimping groove (54), of trapezoidal profile, is made on the cylindrical rear part of the ring (35) with a diameter equal to that of the bearing surfaces (38) of the bullet body (33).

As shown in FIG. 3, the start of the curvilinear ogive (52) is located about 2 mm from the crimping groove (54) for crimping the bullet (32) into the metal cartridge case (36).

The rear face (55) of the ring (35) comes into contact against the shoulder (56) of the bullet body (33). An external chamfer (57) of a few tenths of a millimeter is provided on either side of the contact plane (55, 56).

The ring (35) is linked to the bullet body (33) at assembly by a friction welding technique, through friction on the lands (41) and on the plane of the contacts (55, 56). The external chamfer (57) made on either side of the contact plane (55, 56) makes it possible to accommodate any material irregularities generated by the welding.

An open conical cavity (58) at the head of the bullet is bounded by the cone (50) and the front face (51) of the ring (35), and by the cone (44) of the head of the dart (34). This cavity is extended in a circular manner by the clearances (47) and (46) left between the bores (48) and (45) of the ring (35) and the cylindrical shoulder (43) of the dart (34).

The metallic materials used in this illustrative example of the invention are the same as in the previous example.

The operation of this bullet on a target is similar to that of the subcaliber bullet of FIG. 1, the deformations being similar to those of FIG. 2.

However, the impact velocity on the target is higher and may therefore result in separation of the ring (59), as shown in FIG. 4. The ring can then slide over the bullet body (33), which exerts its penetration effect in the target. However, the expanded ring (59), the bullet body (33) and its dart (34) remain in alignment along the axis of the bullet, even after the ring (59) has separated. This result is favorable to the firing safety of the bullet and to environmental protection.

The volume of the open cavity (58) is determined using the conventional computational techniques depending on the mass of the bullet, its impact velocity and the desired effects on the target.

FIG. 5 shows an alternative embodiment of the bullet of FIG. 1, in which the ring (60) is fastened to the dart (61) integral with the bullet body (62) by means of a thread (63). The thread is machined in such a way as to ensure perfect locking of the ring (60) at the contact plane (64) between the rear face (65) of the ring (60) and the shoulder (66) provided in the bullet body (62).

The front face (67) of the dart (61) and the front face (68) of the ring (60) lie in the same plane.

FIG. 6 shows another alternative embodiment of an expansion ring (69) fitted onto the dart (70) of the bullet body (71) of a subcaliber bullet.

The front part of the dart (70) includes a cone (72), the front face (73) of which protrudes from the front face (74) of the ring (69). The contact surface (75) between ring and dart is smooth, the fitting of the ring (69) onto the dart (70) being carried out hot, the bullet body having been precooled to a low temperature, for example in liquid nitrogen. Clamping by shrink-fitting is then achieved.

The diameter of the bore of the ring (69) in line with the link (75) and the diameter of the dart (70) in line with this same link are determined beforehand by computation, in order to obtain optimum shrink-fitting without deforming the ring (69).

FIG. 7 shows another alternative embodiment suitable for a subcaliber bullet, in which the ring (76) is assembled with the dart (77) of the bullet body (78) by means of diamond-shaped features (80) produced by machining on the rear part of the dart (77). The internal bore (79) to the rear of the ring (76) is smooth and has a smaller diameter than the outside diameter of the machined features (80) of the dart (77).

The ring (76) is assembled onto the dart (77) by forcibly introducing the ring over the machined features (80) until it butts against the shoulder (81) of the bullet body (78).

The front face (82) of the dart (77) is recessed relative to the front face (83) of the ring (76).

The invention is applicable to bullet ammunition for all guns, and more particularly to hunting guns of any caliber, whether with a smooth or rifled barrel.

The invention claimed is:

1. A round for small, medium and large caliber guns, comprising a full-caliber or subcaliber lead free metal bullet comprising a substantially rigid bullet body and a deformable part, wherein the deformable part comprises an approximately cylindrical expansion ring, the rear part of which is fitted onto the front part of the bullet body, wherein accelerated expansion is provided while the loss of mass by fragmentation is prevented, and the expansion ring cooperates with the bullet body to prevent recoil of the bullet body upon impact.

2. The round as claimed in claim 1, wherein the expansion ring includes, on a front face, an emergent frustoconical bore, which cooperates with the front face of the head of the bullet body in order to form an open cavity.

3. The round as claimed in claim 2, wherein the emergent frustoconical bore on the front face of the expansion ring forms, with the external cylindrical part of the ring, a narrow expansion flat or lip.

4. The round as claimed in claim 3, wherein the expansion ring is fitted onto the bullet body by screwing, friction welding, shrink-fitting or force-fitting.

5. The round as claimed in claim 4, wherein the ring is fitted onto the bullet body by a diamond-shaped knurled contact surface.

6. The round as claimed in claim 2, wherein the base of the emergent frustoconical bore comprises an annular bearing surface that bears against the cylindrical surface of the head of the bullet body and is capable of sliding over said cylindrical surface.

7. The round as claimed in claim 6, wherein the annular bearing surface is separated from the rear part of the cylindrical ring by an annular groove.

8. The round as claimed in claim 1, wherein the rear part of the ring comprises a stop that bears against a shoulder on the bullet body.

9. The round as claimed in claim 1, wherein the outer surface of the cylindrical ring is slightly conical.

10. The round as claimed in claim 9, wherein the outer surface of the cylindrical ring has a curvilinear ogival shape.

11. The round as claimed in claim 1, wherein the front face of the expansion ring lies substantially in the plane of the face of the head of the bullet body.

12. The round as claimed in claim 1, wherein the front face of the expansion ring is protruding from the head of the bullet body.

13. The round as claimed in claim 1, wherein the front face of the expansion ring is set back relative to the plane of the head of the bullet body.

* * * * *